United States Patent [19]

Mustonen

[11] Patent Number: 4,592,155

[45] Date of Patent: Jun. 3, 1986

[54] DREDGER WITH TRANSPORT BASIN HAVING LOADING AND UNLOADING MECHANISM

[75] Inventor: Antero Mustonen, Kuopio, Finland

[73] Assignee: Oy Wärtsilä AB, Helsinki, Finland

[21] Appl. No.: 649,553

[22] Filed: Sep. 10, 1984

[30] Foreign Application Priority Data

Sep. 20, 1983 [FI] Finland ..... 833352

[51] Int. Cl.[4] ..... E02F 5/28; E02F 3/04

[52] U.S. Cl. ..... 37/54; 37/71; 414/493

[58] Field of Search ..... 37/54, 56, 71, 75, 76, 37/4, 55; 210/923, 242.3; 414/492, 493

[56] References Cited

U.S. PATENT DOCUMENTS

| | | | |
|---|---|---|---|
| 46,463 | 2/1865 | Gove | 37/54 |
| 110,468 | 12/1870 | Howell | 37/54 |
| 155,664 | 10/1874 | Muse | 414/492 |
| 575,272 | 1/1897 | Potter | 37/54 |
| 1,019,610 | 3/1912 | Donnelly | 37/67 |
| 1,300,111 | 4/1919 | Billings | 414/492 |
| 1,748,931 | 2/1930 | Lehman et al. | 37/54 X |
| 2,091,279 | 8/1937 | Hopkins et al. | 37/71 |
| 2,978,819 | 4/1961 | Paulson | 37/55 X |
| 3,704,784 | 12/1972 | Craggs et al. | 210/923 X |
| 3,804,177 | 4/1974 | Renfroe | 37/71 X |
| 4,070,978 | 1/1978 | Virgilio | 37/54 X |
| 4,446,636 | 5/1984 | Weinert | 37/54 |

FOREIGN PATENT DOCUMENTS

| | | | |
|---|---|---|---|
| 1781256 | 12/1970 | Fed. Rep. of Germany | 414/493 |
| 31377 | 5/1961 | Finland . | |
| 11582 | of 1896 | United Kingdom | 37/55 |

*Primary Examiner*—Clifford D. Crowder

*Attorney, Agent, or Firm*—Dellett, Smith-Hill and Bedell

[57] ABSTRACT

A dredger comprising a floating hull supported on floatable means, for instance on pontoons or the like, a transport basin movably supported at said hull for the reception of a mass lifted from the bottom and means for said movable support, said transport basin including a mainly open front portion and a rear portion, and means for the transfer of the mass from a dredged area into the transport basin. Said transport basin is operated by hoist devices so that at least said front portion of the basin is descendable down to the bottom for said mass reception and hoistable up to a transport position or to a position above said transport position, and said mass transfer means comprise a digger plate or the like, which is movable by means of powered members relative to and within said basin.

18 Claims, 6 Drawing Figures

DREDGER WITH TRANSPORT BASIN HAVING LOADING AND UNLOADING MECHANISM

FIELD OF THE INVENTION

The invention relates to a dredger comprising a floating hull supported on floatable means, for instance on pontoons or the like, a transport basin including a mainly open front portion for the reception of a mass lifted from the sea bottom, and means for the transfer of the mass from the dredged area into the transport basin.

PRIOR ART

Dredger devices of the type referred above, as well as of several other types, are previously known. The Finnish Pat. No. 31377, for instance, describes a floating dredger which is provided with an inclined loading ramp descendable down to the bottom and along which the mass is lifted by means of a drag bucket. It is further usual to provide a vessel, either a normal ship or one constructionally resembling a barge, by a variety of conveyors for lifting the bottom mass in to a loading space as disclosed in Patent Letters DE 664 623, FR 2 434 240 and U.S. Pat. No. 4,394,841. The barge can be provided by a separate conveyor device for the unloading of the mass as shown in Patent Specification DE 664 623. A common excavator for the conveyance of the mass can be positioned on such a barge as well, naturally. A known stabilization of the vessel includes adjustable pontoons supported at the bottom, like in U.S. Pat. No. 3,064,370. Another alternative is to provide a usual big excavator by pontoons, as disclosed in the Published Patent Application DE 2411115.

These dredgers known by art usually have two disadvantages. One the one hand, it is usually not possible to operate the dredger as an entirely independent unit, that is, to carry out both the mass lifting and unloading by same means. The other disadvantage is the rather expensive construction of the devices, especially if one tries to eliminate said earlier mentioned defect when combining said two functions.

THE OBJECT AND SUMMARY OF THE INVENTION

The object of the present invention is to remove these defects and to provide a dredger which is relatively inexpensive and uncomplicated in its construction, which can carry out the dredging task, the transport of the dredged mass and the mass discharge and unloading as an independent unit, but nevertheless may co-operate with a floating separate transport unit for a long distance transportation of the dredged mass to a remote destination. Furthermore, the object includes the aim to construct a dredger which generates as little as possible water disturbance and blurring caused by the mixing of the bottom mass with water, and a dredger which is easily operated at varying water depths and which can carry out embankment work, if necessary. In order to fulfill this task, the dredger according to the invention is characterized in that the transport basin is operated by hoist devices, so that at least the open front portion of the basin can be lowered down to the sea bottom, for the reception of the dredged mass, and be lifted up to a transport position or a position above this. The loading of the basin is carried out by mass transfer means which comprise a digger plate or the like, which is movable by means of power member.

The loading and the discharge of the basin become uncomplicated by means of the descendable basin. The mass conveying or transfer is realized in an uncomplicated and inexpensive manner in comparison, for instance, to a flight- or bucket conveyor, a screw conveyor, suction pump etc.

By carrying out the charge and return motion of the mass transfer means, eventually repeating these measures, the digger plate will push the mass through the open front of the basin and move the mass towards the rear end of the basin. The same type of operation, in reverse order, can be applied to push the mass out of the basin without a need to lower the front end during an unloading stage of the basin.

The digger plate can be located at the fore end of arms comprising a longitudinally extendable reach, for example of telescopic arms or arms movable relative to a guide member or the like, which arms are movably attached to the hull. A favourable construction of the arm-digger plate means is such that the digger plate reach, the path of its motion and the control thereof are is easily arranged, yet the plate can also function as a compact arm digger. This is possible by journalling each arm turnably though a bushing and a shaft and supporting the arm movably at said bushing.

This is very effective if the unloading must be done in shallow waters or on to an embankment.

In a favourable embodiment the transport basin is supported at a horizontal transverse shaft located at a position towards the hull rear relative to the central point of the basin. The basin being tiltable or turnable relative to this shaft, the front portion of the transport basin will extend to the bottom. The digger plate being driven in the bottom mass in front of the transport basin, this digger plate conveys the mass into the basin. The pull action of the digger plate tends to drive the fore end of the basin in to the mass, but as understood from the balancing effect of these actions, no auxiliary forces are necessary for maintaining the dredger itself stationary.

The transport basin being open at its front portion said digger plate can operate as the basin open front closing member when the digger plate is retracted into a position in the basin. The dredger can further comprise preferably two longitudinal pontoons, between which basin is located. A stable dredging task is easily carried out when the pontoons extend beyond the basin. According to one embodiment, the transport basin is further provided by longitudinal guides connected to the dredger hull. Hereby the basin is movable in the longitudinal direction, which embodiment is favourable especially when carrying out embankment tasks. If necessary, the dredger can also in this case be provided with transverse members driveable into the sea bottom or the soil, for instance with bars, by means of which the reverse motion of the dredger is prevented during a mass pushing-away from the basin. In such cases where the water depth is sufficient for a mass discharge on to the bottom, a precisely located discharge is possible by simply lowering the front portion of the transport basin and by holding the dredger stationary by these transverse members.

The capacity of the dredger basin is at least 50 cubic meters, preferably 100 . . . 150 $m^3$, and the maximum vertical motion of the front portion during a tilt action at least 4 m, preferably 6 . . . 25 m. The vertical motion is hereby arranged relative to the turning axis of shaft of the basin. In shallow waters the actual vertical motion can be considerably smaller than the maximum value, naturally. If the entire basin is first descended below the water level, said turning axis is located below its transport location, too. An economically optimized operation is possible by the co-operation of the dredger and a floating unit, for instance a transport vessel.

BRIEF DESCRIPTION OF THE DRAWINGS

The invention and its other advantages and embodiments are described in the following in the fashion of examples and with reference to the attached drawings in which FIG. 1 discloses, schematically in a section, a side view of a dredger embodiment according to the invention during a loading phase, FIG. 2 discloses schematically an embodiment as a sectioned front view.

BEST MODE OF THE INVENTION

Figure 1:
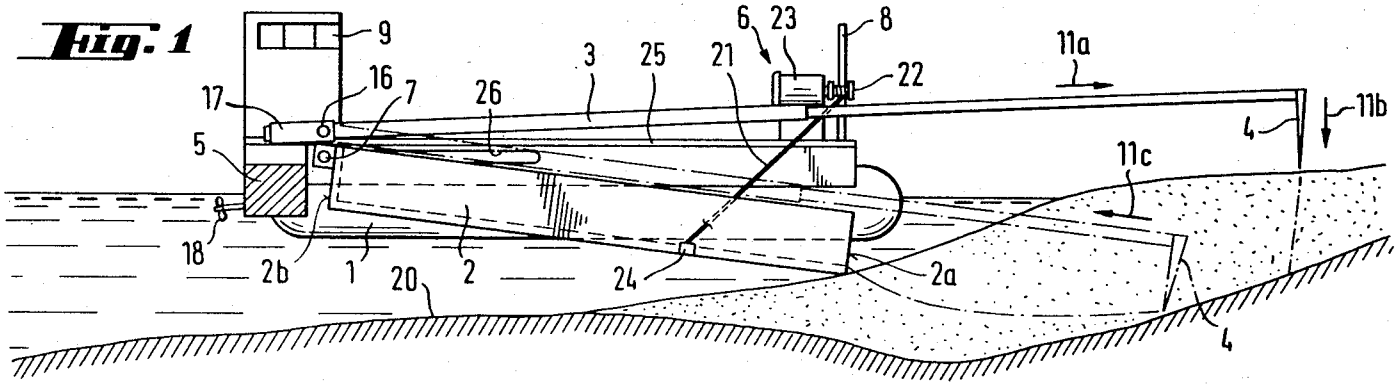
Figure 2:
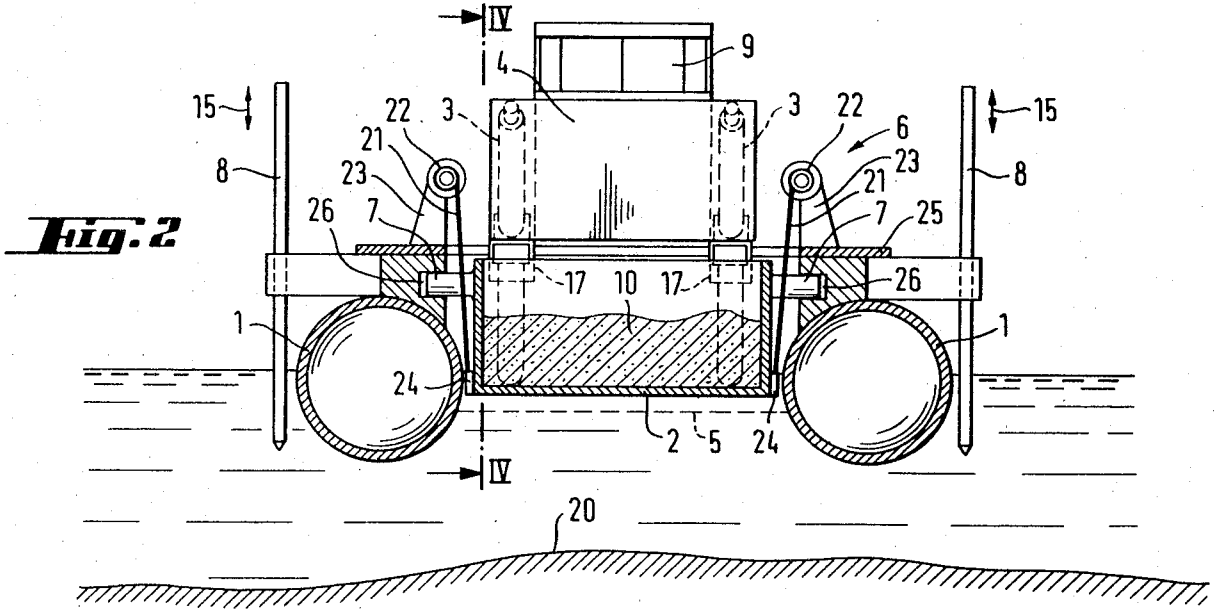

With reference to FIG. 1 and FIG. 2, the drawings show two longitudinal pontoons 1 which operate as load-bearing, floating portions of a dredger. The parallel located pontoons are connected to the dredger hull 5 by means not shown. The pontoons can be of metal or of glass-fibre reinforced plastics. Between the pontoons is located a rectangularly shaped transport basin 2, which is open at its front end 2*a* and, at its rear end 2*b*, turnably journalled at hull 5. Basin 2 is journalled via a shaft 7, around which basin 2 is rotatable. Further journalled at hull 5 are two telescopic arms 3, at the front end of which is attached a digger plate 4. These arms 3 are journalled via a shaft 16, each arm 3 movably supported at a bushing 17. The dredger is preferably provided with its own propeller engine or the like for driving a propeller 18 and a control cabin 9, from which the dredger tasks are operated. Reference numerals 11*a–c* refer to digger plate's 4 motions during the mass loading stage.

The essence of the invention is that transport basin 2 can be hoisted and lowered relative to hull 5 by hoist devices 21–24, which are shown schematically only and referred by a general reference numeral 6. Hydraulic cylinders, for instance, can be used as hoist devices in rather small dredgers, whereas wire cables 21 or chains wound by winches 22,23 are more appropriate in larger appliances. The dredger includes a deck construction 25. The hoist cable 21 is attached to basin 2 at a location 24.

The front portion 2*a* of basin 2 is lowered down to the sea bottom 20 during the loading phase and the mass 10 is moved in to the basin via open front end 2*a* by means of telescopic arms 3 and digger plate 4. As obvious from the Figure, no auxiliary devices are needed for keeping the dredger itself static. Digger plate 4 and the handled mass move relative to basin 2, and these movements cause a reactive opposite force, by which the basin either is maintained stationary or itself cuts into the mass in a direction opposite to the digger plate motion. FIG. 2 shows digger plate 4 in its position during a transport phase and lifted above basin 2. During an unloading of basin 2, this corresponds the starting of a reverse motion of plate 4.

Figure 3:
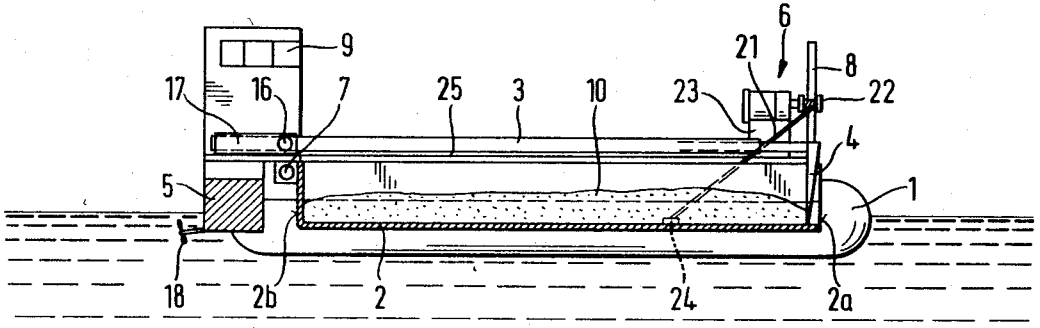
FIG. 3 shows in a section the dredger in a transport position, FIG. 4 discloses in a section the dredger in the transport position, at a beginning of an unloading phase, FIG. 5 discloses in a section a discharge on the bottom in deep water, and FIG. 6 discloses in a side view a dredger carrying out an embankment task.

The basin is filled by one or more charges or pulls and, basin 2 being filled, it is hoisted up by hoist devices 6 into the position shown in FIG. 3. Digger plate 4 can be so dimensioned, that it forms a closing member of front portion 2*a* of basin 2.

Figure 4:
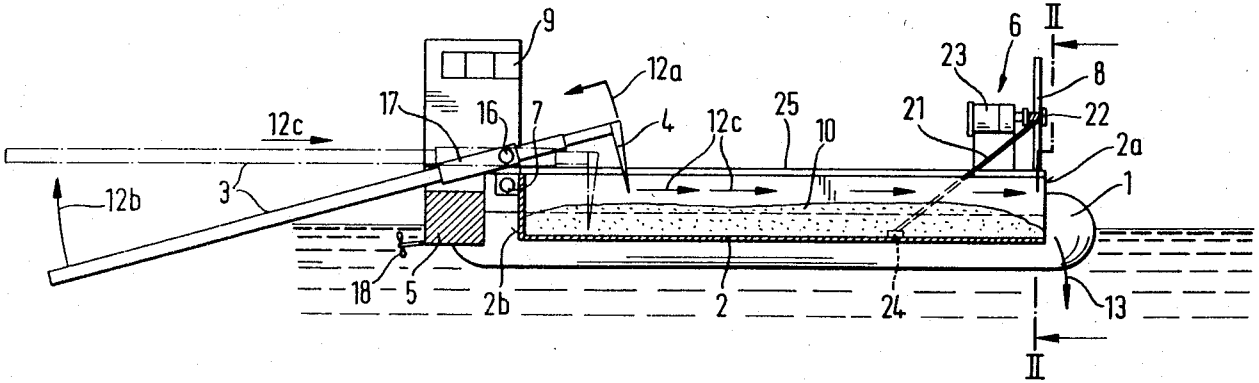
Figure 5:
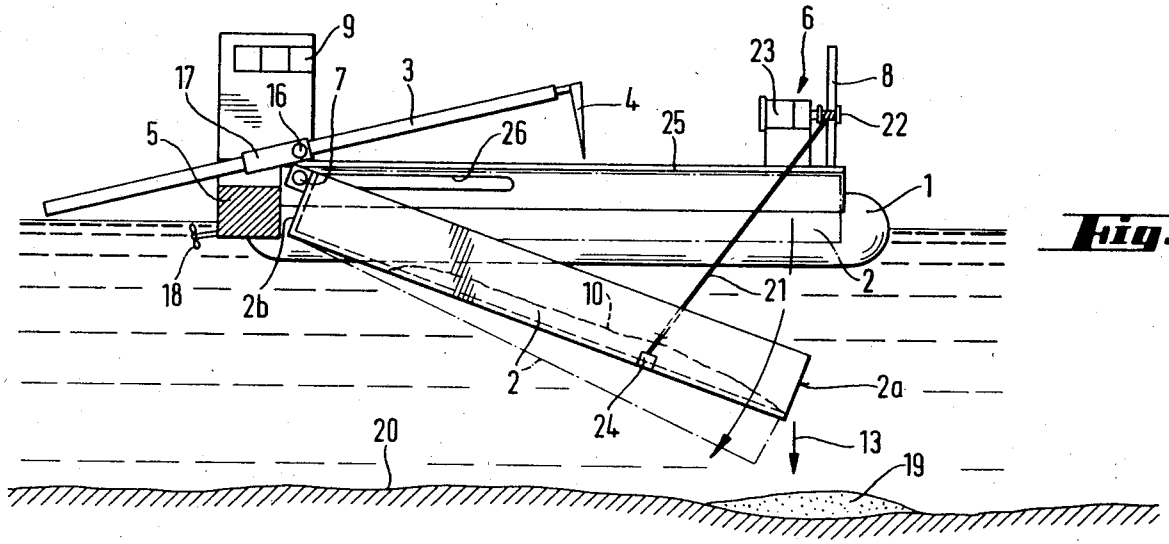

The unloading or discharge can be carried out by pushing the mass from basin 2 by means of digger plate 4, as shown in FIG. 4. The movable support of arm 3 at bushing 17 is hereby such, that arm 3 be longitudinally moved relative to bushing 17. The telescopic arms 3 can be replaced by rigid arms, which can be moved relative to bushing 17 or a guide allowing the reach adjustment of arm 3. Reference numerals 12*a–c* refer to the motions of plate 4 and arms 3 during the mass pushing and numeral 13 to down-falling unloaded mass. Another alternative is the lowering the front portion 2*a* by tilting basin 2 down, as shown in FIG. 5. It is clear that basin 2 can include a discharge bottom like in a hopper barge or it can even be emptied by an external device, if necessary. Mass collected at sea bottom 20 is referred by numeral 19.

In view of the energy consumption, it might be favourable to locate turning shaft 7 of basin 2 more close to the central point of the basin, especially if the dredger is rather large, like comprising a capacity of 500 . . . 1500 $m^3$. That portion of basin 2 between shaft 7 and rear end 2*b* operates hereby as a counter-weight, which reduces the requires power for the up-lifting of the filled basin 2. It is clear that the entire transport basin can be made descendable and hoistable within the scope of invention, although a rotatable journalled turning is more appropriate in practice.

Figure 6:
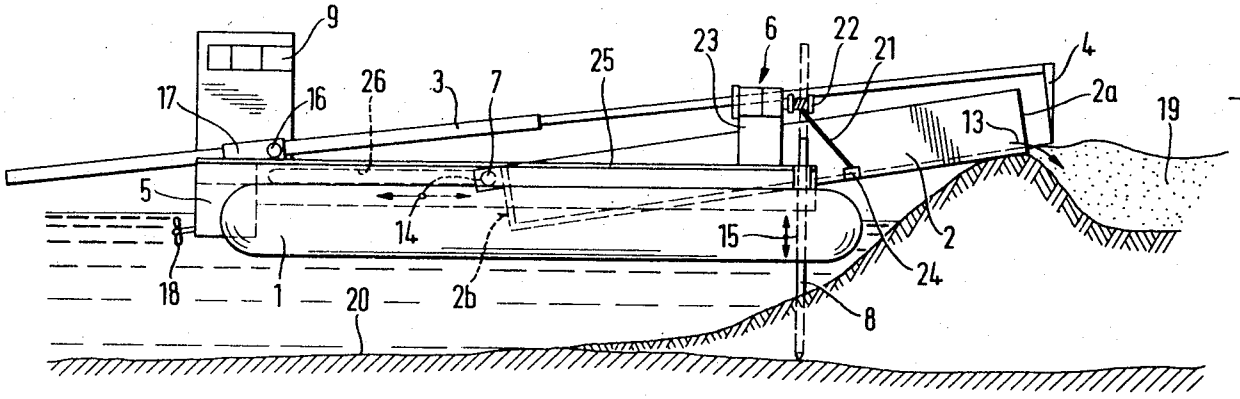

In addition to that transport basin 2 can be descended and hoisted, it can also be moved in the longitudinal direction relative to hull 5, for instance supported at guides 26 located at inner sides of hull 5 or both pontoons. This situation is shown in FIG. 6, although the guides 26 are only briefly sketched in the FIGS. 1, 2, 5 and 6. The motion of shaft 7 is indicated by numeral 14 in FIG. 6. An arrangement of this kind is favourable especially when carrying out an embankment task, because the transport basin can be pushed forward on shore and, thus, the lifted mass moved on beach. It is favourable, especially for such work, to provide the dredger by, for instance hydraulically operated, vertically movable 15, transverse members 8 driven into the bottom or the soil, which prevent a reverse motion of the dredger appliance during the unloading or discharge of the transport basin. Reference numerals 13 and 19 refer to a mass amount unloaded and collected on the embankment.

FIG. 1 shows a loading phase in which front portion 2*a* is descended less than the maximum vertical value, which is at least 4 m, preferably 6 . . . 25 m. In an eventual descending of the entire basin, these values are related to the new location of the turning axis or shaft 7, relative to which the tilting is done. FIG. 5 shows a discharge phase in which front portion 2*a* is descended by an intermediate amount.

The invention is not limited to embodiments shown but several modification thereof are feasible within the scope of the invention. Instead of members 8 shown in FIG. 6, basin 2 can be provided with attachment means like spikes drivable in soil or hook members or the like. Spikes are applied to anchor the basin front end to the embankment. Hooks can be used if the mass from basin 2 is unloaded into a transport vessel, which is considerably larger than the dredger. This is favourable if, for example, a small dredger comprising a capacity of at least 50 $m^3$, and about up to 500 $m^3$, operates in an area far from the final destination of the dredged mass. The transport vessel usually being higher than the dredger, the basin 2 is upwards inclined with its front portion 2*a* located high and suitable anchored to the vessel.

I claim:

1. A dredger comprising a hull structure, flotation means for supporting the hull structure at the surface of a body of water, an elongate transport basin for receiving material lifted from the bottom of the water body and being open at the top and at at least one end, means supporting the transport basin movably with respect to the hull structure so that at least said one end of the transport basin can be lowered to the bottom of the water body for receiving material from a dredged area and can be raised up to a transport position in which the dredger can be moved to a discharge location for discharging material from the transport basin, a digger plate, a power transmission member mounted on the hull structure and connected to the digger plate, and power means connected to the power transmission member for moving the digger plate within the basin in one direction for drawing material from the dredged area into the transport basin by way of the open end thereof when the transport basin is in its lowered position, and for moving the digger plate in the opposite direction to push material from the transport basin by way of said open end for unloading the dredger.

2. A dredger according to claim 15, wherein the power transmission member comprises at least one longitudinally extendable elongate arm having two opposite ends, said arm extending longitudinally of and above the transport basin and being movably attached to the hull structure, and the digger plate being secured to the arm at that end thereof which is towards the open end of the transport basin.

3. A dredger according to claim 2, wherein the arm is telescopic.

4. A dredger according to claim 2, comprising a support guide for said arm, the arm being supported by and movable longitudinally relative to the support guide.

5. A dredger according to claim 2, comprising a rotary shaft mounted to the hull structure with its central axis extending horizontally, substantially perpendicular to the longitudinal dimension of the transport basin, and a bushing secured to the rotary shaft and extending perpendicular to the longitudinal axis thereof, and wherein said arm extends through said bushing, whereby rotation of the shaft causes raising and lowering of the digger plate.

6. A dredger according to claim 5, wherein the arm is movable longitudinally within the bushing.

7. A dredger according to claim 1, wherein the open end of the transport basin is directed towards a forward end of the hull structure, and the dredger also comprises a horizontal shaft supported by the hull structure at a rear end thereof, the basin being supported by the hull structure through said horizontal shaft and being pivotable relative to the hull structure about said shaft.

8. A dredger according to claim 1, comprising guide means secured to the hull structure and extending longitudinally of the transport basin, the transport basin being supported by the hull structure through said guide means, the guide means permitting movement of the basin in its longitudinal direction relative to the hull structure.

9. A dredger according to claim 1, wherein the open end of the basin is directed towards a forward portion of the dredger, and the dredger comprises anchoring means located at said forward portion of the dredger for securing the dredger against longitudinal movement relative to the bottom of the water body.

10. A dredger according to claim 9, wherein the anchoring means are mounted to the hull structure.

11. A dredger according to claim 9, wherein the anchoring means comprise transverse members drivable into the bottom of the water body.

12. A dredger according to claim 1, wherein the flotation means comprise two pontoons and the transport basin is supported between the two pontoons, the pontoons each extending horizontally beyond the transport basin.

13. A dredger according to claim 1, wherein the transport basin is closed at its end opposite said one end, and a digger plate is movable within the basin from said one end to said opposite end.

14. A dredger according to claim 1, wherein a digger plate can be positioned to substantially close the open end of the transport basin.

15. A dredger according to claim 1, wherein the transport basin is pivotable relative to the hull structure between its lowered position and its transport position, the vertical movement of the open end of the transport basin during pivoting being at least 4 meters, and the capacity of the basin is at least 50 cubic meters.

16. A dredger according to claim 15, wherein the vertical movement is in the range from about 6 meters to about 25 meters, and the capacity of the basin is in the range from about 100 $m^3$ to about 1500 $m^3$.

17. A dredger according to claim 1, wherein the basin is supported relative to the hull structure in a manner permitting movement of the basin in its longitudinal direction relative to the hull structure and also permitting the basin to be tilted upwards at said one end, in order to facilitate transfer of material from the basin to a location above the transport position of the basin.

18. A dredger according to claim 1, wherein the transport basin has a floor having two opposite edges that extend longitudinally of the transport basin, and also has two longitudinal walls, at said opposite edges respectively of the floor and extending upwardly from the floor, the floor and the walls being essentially imperforate.

* * * * *